United States Patent [19]

Donaghue et al.

[11] 4,151,022

[45] Apr. 24, 1979

[54] IMMOBILIZED EXPLOSIVE COMPONENT IN FOAMED MATRIX

[75] Inventors: Paul F. Donaghue, Bundoora; Kenneth A. W. Mitchell, Elwood, both of Australia

[73] Assignee: ICI Australia Limited, Melbourne, Australia

[21] Appl. No.: 851,384

[22] Filed: Nov. 14, 1977

[30] Foreign Application Priority Data

Nov. 29, 1976 [AU] Australia ..... 8310/76

[51] Int. Cl.[2] ..... C06B 45/10

[52] U.S. Cl. ..... 149/19.4; 149/19.1; 149/19.5; 149/60; 149/61; 149/76; 149/83; 149/109.6

[58] Field of Search ..... 149/2, 19.1, 19.4, 19.5, 149/109.6, 2, 60, 61, 76, 83

[56] References Cited

U.S. PATENT DOCUMENTS

| | | | |
|---|---|---|---|
| 3,706,607 | 12/1972 | Chrisp | 149/2 |
| 3,790,415 | 2/1974 | Tomic | 149/2 |
| 3,902,933 | 9/1975 | Chandler | 149/2 |
| 4,025,369 | 5/1977 | Price et al. | 149/2 X |
| 4,026,738 | 5/1977 | Richard | 149/2 X |

*Primary Examiner*—Stephen J. Lechert, Jr.
*Attorney, Agent, or Firm*—Cushman, Darby & Cushman

[57] ABSTRACT

An explosive composition comprising a dispersion of an explosive component which is located in and immobilized by a foamed non-explosive matrix.

17 Claims, No Drawings

IMMOBILIZED EXPLOSIVE COMPONENT IN FOAMED MATRIX

This invention relates to explosive compositions and more particularly it relates to explosive compositions comprising a dispersion of explosive material located in and immobilized by a non-explosive foamed matrix, and to processes whereby such compositions may be made.

Explosive compositions have been known for several centuries and have been used in a variety of forms such as in the form of free flowing gunpowder; as a gelatinized material such as a dynamite wherein an explosive is dispersed in an extruded gel form; as a free flowing mixture of particulate oxygen releasing salts and a liquid organic fuel; or as a water based slurry comprising oxygen releasing salts, fuel material and water. Such compositions have been useful as sources of energy which could be utilized for firing ammunition or for use as blasting agents. Hitherto generally such explosives have been manufactured in a manner having as its objective an explosive composition in which the ratio of latent energy per unit volume of the composition is as great as possible. Thus for example in the specification of U.S. Pat. No. 2,768,072 there is described a process for making an explosive composition wherein a high explosive such as trinitrotoluene, nitrocellulose, pentaerythritol or cyclotrimethylenetrinitramine is dissolved in a organic solvent, and the solution is added to a gelled polymeric resin which is then foamed by injection of air to provide a cellular explosive which has a greater and more shattering effect than the same weight of high density explosive. It has been proposed in Australian Patent Specification No. 231,043 to provide a self supporting deformable explosive composition having a high density and a high detonation velocity and which comprises a high explosive compound admixed with a binding agent consisting of an elastomer such as butyl rubber and a thermoplastic terpene hydrocarbon resin such as a polymer a beta-pinene. It has also been proposed in U.S. Pat. No. 3,256,214 to prepare explosive resins comprised of crosslinked thermosetting polymers typified by modified polyurethanes having as an essential component nitric acid ester groups. Such explosive resins are claimed in U.S. Pat. No. 3,309,247 to be useful for coating ammonium nitrate compositions. This objective of developing compositions having such a great ratio was laudable, especially when the explosive industry was in its infancy and it was difficult to produce high powered explosives, since it reduced to costs of packaging, transporting or storing the explosive compositions and minimized the volume of explosive necessary to achieve a desired result when the latent energy thereof was released by detonation. With the development of technology relating to the manufacture of explosives the ratio of latent energy per unit volume of explosive is often very great with modern explosives and it has now become desirable to be able to control the effect of the release of the energy in a manner which is more efficient than has hitherto been possible. Thus it has been proposed to mix explosive materials with a low density inert material and a typical example of such a mixture is described in the specification of British Pat. No. 1,177,732 wherein a high explosive material is admixed with spherical particles of a filler having a density of less than 0.1. This type of explosive is exemplified by a composition wherein filler particles of foamed polystyrene or foamed polyurethane are coated with the explosive material to provide an explosive having a fluid-bed consistency. It has also been proposed in British Patent Specification No. 1,239,771 to provide an explosive charge comprising a sintered homogeneous mixture of a granular meltable explosive such as trinitrotoluene and a gas-containing, porous or voluminous substance such as microspheres and foam plastics or powdered cork. Yet again in Australian Patent Specification No. 204,739 it has been proposed to grind an oxidizing salt to a very fine powder, add it to a liquid phenol-, urea- or melamine-formaldehyde condensation product and thereafter polymerize the condensate to provide a stable solid pyrotechnic mass suitable for fireworks. It has been proposed also in Australian Patent Specification No. 287,723 to provide a process for the manufacture of explosives having a rigid structure from insensitive explosive substances in which the explosive substances are mixed with at least one plasticizer to give them a gelatinous structure followed by a heat treatment whereby the gelatinous structure is changed into a rigid structure, the plasticizer also coating the explosive substances within the mixture.

We have now discovered a new explosive composition which differs essentially from explosive compositions of the prior art and which were typified by the compositions referred to above. Our discovery relates to explosive compositions having a relatively low density and in which the proportion of the explosive component may be varied over a wide range. In a broad form out invention relates to explosive compositions comprising a non-explosive matrix in which a particulate explosive component is located, the compositions being made by a process whereby first the matrix is formed as a foam in situ and has blended and dispersed therein the explosive component, and secondly the foamed explosive composition so formed is converted to a solidified foam.

Accordingly there is provided an explosive composition comprising a dispersion of an explosive component which is located in and immobilized by a foamed non-explosive matrix.

The nature of the explosive component is not narrowly critical and may be chosen so as to be suitable for the purposes to which the composition is to be put. Thus for example the explosive component may comprise suitable amounts of one or more inorganic oxygen-releasing salts used conventionally in the preparation of explosive compositions and typified by thenitrate, chlorate and perchlorate of alkali metals, alkaline earth metals and ammonium, especially the nitrates such as calcium nitrate, potassium, nitrate or sodium nitrate, and especially ammonium nitrate, in the form of prills, particles or powders; or a mixture comprising inorganic oxygen-releasing salts and liquid fuels such as the well known mixtures of ammonium nitrate and fuel oil, or a mixture of an alkaline earth salt and fuel which may be typified by a mixture of calcium, nitrate, ethylene glycol and diesel oil; or a water based explosive material comprising oxygen-releasing salt material, fuel material and water which may be in the form of a slurry or in the form of a friable solid. Although the compositions of the invention may contain high explosive materials such as trinitrotoluene, pentaerythritol cyclotrimethylenetrinitramine and the like they are not essential components of the compositions and when present, say in a role of a sensitizing agent, the proportion thereof in the composition should be a comparatively minor one. The proportion of the explosive component in the compositions of the invention may be varied to suit the desired energy requirements of the compositions, and it will be apparent that the same energy may be derived from differing proportions of alternative explosive components. Furthermore the explosive component may need to be modified in its porportion or its composition dependent on the chemical or physical nature of the foamed matrix in which it is immobilized and located. For most practical purposes satisfactory explosive compositions according to the invention are those wherein the explosive component constitutes from 40 to 95% w/w, more usually from 60 to 90% w/w of the composition.

Suitably the matrix of the composition is formed of material the apparent density of which is decreased substantially by the presence of numerous cells disposed throughout its mass. Conveniently the matrix may be in the form of a foam which may be flexible, but which preferably is rigid. The cells of the matrix may be interconnected to provide a foam of the open-cell type or they may be discrete to form a closed cell foam. The matrix may be prepared from either organic material such as condensates, resins or polymers or foam inorganic materials such as vermiculite or silicates. Suitable materials of which the matrix may be comprised include polyolefins such as polyethylene or polypropylene, polyurethanes, polycyanurates, polyisocyanurates, urea-formaldehyde resins, melamine-formaldehyde resins, phenol-formaldehyde resins, polyureas, polyesters, polyethers, epoxy resins, alkyd resins, linseed oil resins, polystyrene, polyacrylates, polyalkacrylates, polyamides, polybutadienes, polysulphides, natural rubber based compositions, synthetic rubber based compositions such as the socalled SBR or SBS rubbers, or inorganic polymers such as polysiloxanes or boron polymers. Mixtures of such polymers may also be used to form the matrices of the compositions of the invention. Yet again, satisfactory matrices may be prepared from copolymers for instance a copolymer derived from ethylene and vinyl acetate, or from acrylonitrile, butadiene and styrene.

The compositions of the invention may be made by a variety of processes in which the method of forming the matrix or the order of incorporating the explosive component in the foamed component is not narrowly critical. Thus for example it lies within the invention to make the compositions of the invention by forming a latent foamable composition, adding thereto an explosive component and then treating the mixture so prepared with a catalyst so as to form a foamed explosive composition of the invention. In another process in explosive component may be dispersed in a material which is a first component of a foamable composition and the dispersion so formed may be added to a second component of a foamable composition to form an explosive composition of the invention. Yet again such a composition may be prepared by adding to a foam in a mobile forth form an explosive component and a catalyst capable of converting the mobile foam froth to a solidified form. Still further the compositions of the invention may be made by the simultaneous mixing and blending of explosive and matrix forming components. These typical examples of processes for making the compositions of the invention have as a common aspect the preparation of a mobile froth or foam to which is added an explosive component to form a mobile explosive froth which is then converted to a solidified foam. The conversion of the mobile froth to a solidified form may, for example, be effected by the introduction of a solidifying catalyst into the forth. An alternative method of treating the mobile froth is to allow the heat generated by the reaction of the materials from which the froth is being made to act as a treating means whereby the mobile froth is converted to a non-mobile form.

Accordingly in a broad embodiment of the invention there is provided a process for the preparation of an explosive composition which process comprises, in combination, dispersing an explosive component in a mobile foam to form a mobile explosive foam and treating said explosive foam so as to convert it to a solidified foamed matrix in which the said explosive component is located and immobilized.

In another embodiment of the invention there is provided a process for the preparation of an explosive composition which process comprises the steps of blending an explosive component with a non-explosive foamable material and reacting the blend so formed with a catalyst so as to form a solidified foamed matrix in which the said explosive component is located and immobilized.

In another embodiment of the invention there is provided a process for the preparation of an explosive composition which process comprises the steps of blending an explosive component with a non-explosive foamable material and reacting the blend so formed with a catalyst so as to form a solidified foamed matrix in which the said explosive component is located and immobilized.

Still further there is provided as an embodiment of the invention a process for the preparation of an explosive composition which process comprises the steps of blending an explosive component with a first component of a non-explosive foamable material, admixing therewith a second component of a non-explosive foamable material so as to form an explosive mobile foam and thereafter converting said explosive foam to a solidified foamed matrix in which the said explosive component is located and immobilized.

Yet again in a further embodiment of the invention there is provided a process for the preparation of an explosive composition which process comprises the concurrent mixing of a first component comprising explosive material with a second component and a third component, said second and third components being such that when mixed together they form a solidifiable mobile foam, and thereafter converting the mobile explosive foam so formed to a solidified foamed matrix in which the said explosive component is located and immobilized.

There is also provided as an embodiment of the invention a process for the preparation of an explosive composition which process comprises blending two or more materials which when mixed together form a solidifiable mobile foam, adding to the foam so formed an explosive component so as to form an explosive mobile foam, and treating said explosive foam so as to convert it to a solidified foamed matrix in which the said explosive component is located and immobilized.

The nature of the blending step referred to above will depend to some extent on the nature of the foamable material. Thus if the foamable material comprises a monomer or a prepolymer which is in a liquid form, then blending may be achieved using conventional methods for blending liquids with explosives. If on the other hand the foamable material is in the form of a solid it will usually be necessary to convert the foamable material to a liquid or pasty form in a preliminary step prior to blending it with the explosive component. Yet again if the foamable material is derived by mixing two or more liquid components then it is convenient to form a first blend of the explosive component with a first liquid component followed by a further blending of the residual liquid components with the first blend to form a second blend. Alternatively the liquid components and the explosive component may be mixed concurrently.

The conversion of the foamable material to a foamed form may be achieved by a variety of methods. These methods include a process of expanding a fluid polymer phase to a low density cellular state and then preserving this state. This process may be termed a foaming or expanding process and may, for convenience of description, be divided into three steps comprising creating small discontinuities or cells in a fluid or plastic phase, causing these cells to grow to a desired volume, and stabilizing the cellular structure so obtained by physical or chemical means. The preparation of cellular matrices of polystyrene, polyvinyl chloride, polyethylene or of a copolymer of styrene and acrylontrile are examples of the process wherein the cellular structure may be stabilized by physical means. Thus in the instance of a matrix of polystyrene a matrix may be prepared by heating polystyrene particles—admixed with an explosive component-in the presence of a blowing agent and allowing the blowing agent to penetrate the particles. Alternatively styrene monomer may be polymerized in the presence of a blowing agent so that the blowing agent and the explosive component is entrapped in the expanded polymer. Typical blowing agents used in such steps are the various isomeric pentanes, hexanes or halocarbons. Foamed polyethylene matrices may be made by treating granules in a similar manner in the presence of decomposable blowing agents such as azodicarbonimide or dinitrosopentamethylene tetramine. Cellular structures of matricies derived from monomeric or prepolymeric materials suitable for the formation of polyurethanes, polycyanurates, polyisocyanurates, epoxy resins, phenolics or silicone resins may conveniently be stabilized by chemical means. Thus for example in the instance where the process comprises the preparation of a cellular polyurethane it may be convenient to use the well known and so-called "one-shot" process wherein all the ingredients for producing the foam are mixed together so that the reactions begin immediately, expansion starts very shortly thereafter and the entire expansion is complete within a few minutes and is followed by a period wherein the foam so produced is cured. Another method suitable for preparing polyurethane foams is the so-called "prepolymer" process wherein a polyhydroxy component is reacted with an excess of isocyanate to form a prepolymer which is then reacted with water to simultaneously release carbon dioxide for expansion and link the chains together into a crosslinked matrix. Yet again such a foam may be made by mixing a prepolymer containing excess isocyanate with more polyhydroxy resin and a foam is then formed using a separate blowing agent such as a halocarbon. Suitable cellular polymeric matrices may also be made by a frother process wherein a gas is dispersed in a fluid which has surface properties proper to produce a foam of transient stability and the foam so produced is then stabilized permanently by chemical reaction. The fluid may be a homogeneous material, a solution or a heterogeneous material. A typical example of such a process is the preparation of cellular urea-formaldehyde resins in which for example porous ammonium nitrate may be dispersed. Such a process may comprise the dispersion of a frothing agent in an urea-formaldehyde syrup to which is added the porous particles followed by a material which activates the frothing agent and forms a matrix in which the particles are embedded. In a variation of such a process a solution of a surfactant and a catalyst may be converted to an initial fine-celled foam by dispersing air into it by mechanical means. An amount of an explosive component may be dispersed into a partially cured urea-formaldehyde resin and the resultant mixture mixed into the initial foam by mechanical agitation whereupon the catalyst in the initial foam causes the dispersed resin to cure in a cellular state to form a matrix containing the explosive component. Suitable matrices may also be prepared by treatment of inorganic materials and of such materials the mineral vermiculite is representative. Vermiculite is amenable to conversion to a rigid foamed form and a very suitable process for such a conversion is that set out in British Patent Application No. 14764/76 wherein solid cellular vermiculite having a density of less than 0.1 gram per cubic centimetre is obtained.

The products of the invention are explosive compositions which may be detonated by conventional means. Dependent to some extent on the nature of the matrix, they may be fabricated into a variety of shapes which can be transported to a site at which they can be used. In a typical fabrication procedure the explosive and foamable components for making the composition may be placed in a shaped container and then converted to a solid form and then removed from the container. Such a procedure is useful when for example it is desired to make explosive compositions in the form of unwrapped explosive cylinders. Yet again the compositions in an unsolidified form may be fed into conventional cartridging material such as cardboard, paper, laminated packaging materials like waxed paper or comprising plastic films or made from a metal foil in conjunction with a plastic or paper film, and then allowed to solidify whilst being confined by the cartridging material. Yet again the compositions of the invention may be fed to a borehole as an unsolidified foam and allowed to solidify therein. The products of the invention have excellent resistance to water in comparison with the similar resistance of the explosive component of the composition since the matrix itself acts as a barrier which protects the explosive component from the action of external materials. The matrix also acts as a means whereby a desired amount of an explosive component may be located and immobilized in a desired position. The matrix is also advantageous in that it minimizes and usually prevents the migration of ingredients of the explosive component from the interior to the exterior surface of the composition or of any packaging material in which the composition may be located. By suitable choice of the materials and techniques used in the foaming and stabilizing steps of the process used in the invention the physical characteristics of the resultant product may be controlled to provide matricies of differing degrees of flexibility, hardness or density. The suitability of the process for controlling the density of the product—which conveniently may lie in the range from 0.05 to 0.7 gram per cubic centimetre—is of particular importance in so far as it provides a means whereby the amount of explosive composition located within a given space may be controlled especially in the instance where the explosive composition is to be used in relatively small amounts to dislodge, disperse or remove an amount of material. The process is particularly useful for the control of the bulk energy of explosives for use in areas where soft rock or overburden is to be blasted, and especially in areas where the strength of the rock to be broken varies across a face.

The invention is now illustrated by, but is not limited to, the following examples in which all parts or percentages are on a weight basis unless otherwise specified.

EXAMPLE 1

5 parts of calcium carbonate powder were dispersed in 100 parts of an aqueous dispersion of a urea-formaldehyde condensate containing 60% solids and having a viscosity of 500 centipoises. To this dispersion there was added 100 parts of porous ammonium nitrate prills and the resultant mixture was stirred. 10 parts of phosphoric acid were then added to the stirred mixture whereupon a foam began to form. After 10 minutes from the addition of the phosphoric acid the development of the foam had ceased substantially and during the subsequent 16 hours the foam was converted to a hard form in which the prills were dispersed. There was thus obtained a detonable explosive composition having a density of 0.57 gram per cubic centimeter.

EXAMPLE 2

The general procedure of Example 1 was repeated except that the amount of ammonium nitrate prills was increased to 300 parts. The composition so obtained had a density of 0.70 gram per cubic centimeter.

EXAMPLE 3

3480 parts of porous ammonium nitrate prills were intimately mixed with 288 parts of "Suprasec" PRE until the prills were coated and partially impregnated with the "Suprasec" PRE. ("Suprasec" is a registered trade mark, and "Suprasec" PRE is the trade name for a mixture of tolylene isocyanates). To the mixture so prepared there was added 240 parts of "Daltolac" 41 ("Daltolac" is a registered trade mark) which is an alkylene oxide condensate of an amine. The mixture was converted to a foam form in which the prills were suspended and a portion of the foam was transferred to a cylindrical steel pipe which had an internal diameter of 5 centimeters and a length of 60 centimeters. The foamed product so obtained became hard and was then detonated using a 48 gram booster of pentolite and a No 8 aluminium detonator. The velocity of detonation was 3.2 kilometers per second.

EXAMPLE 4

The general procedure of Example 3 was repeated except that the "Suprasec" PRE of that example was replaced by 288 parts of a blend of diisocyanto diphenylmethane based isocyanates available commercially as "Suprasec" DND. The velocity of detonation was 3.7 kilometers per second.

EXAMPLE 5

An amount of porous prilled ammonium nitrate was ground in a ball mill until 95% of the particles in the product so obtained had a maximum dimension of between 10 and 200 microns. 3480 parts of this powdered product was tumble mixed with 100 parts of "Suprasec" DND and then 164 parts of "Daltolac" 41 was admixed therewith. A foam was formed and the product was found to be a detonable flexible foam in which powdered particles were embedded.

EXAMPLE 6

47 parts of porous ammonium nitrate prills were admixed with 10 parts of "Daltolac" 41 to provide coated prills. There was then added to and mixed with the coated prills 12 parts of "Suprasec" PR which is a trade name for a mixture of 2,4- and 2,6- tolylene isocyanates. Within one minute of making that addition foaming of the mixture commenced. The foamed product thus obtained was a detonable explosive composition in which ammonium nitrate was embedded in a hard foamed matrix. The product had a density of 0.1 gram/cubic centimeter.

EXAMPLE 7

1200 parts of porous ammonium nitrate prills were tumble-mixed with 72 parts of diesel fuel oil so as to coat the prills with oil. 100 parts of "Daltolac" 41 were then tumble-mixed with the oil treated prills and finally 120 parts of "Suprasec" PR was added, whereupon foaming of the mixture commenced. The foaming mixture was allowed to react for 16 hours and there was thus obtained a detonable explosive composition having a density of 0.62 gram per cubic centimeter.

EXAMPLE 8

This example illustrates the preparation of an explosive composition wherein a explosive component comprising a mixture of ammonium nitrate and fuel oil is located in and immobilized by a foamed non-explosive matrix, the matrix having been formed in situ from a curable urea-formaldehyde composition.

1000 parts of an urea-formaldehyde syrup containing 45% of solids was added to a mixture of 320 parts of water, 20 parts of an anionic surfactant available from Albright and Wilson Limited under the Trade Name of "Empimin" AQ 60 and which is believed to comprise an ammonium salt of an alkyl ether sulphate, and 1 part of sodium hydroxide. The resultant product was fed to a conventional foam generating apparatus and treated in a manner such that there was prepared an aerated foam having a density of 0.1 gram per cubic centimeter. The foam so produced was fed as a first component of an explosive composition at a rate of 102 parts per minute through a first orifice of a mixing and dispensing device and comprising a rotatable member in the form of an auger or screw. Such devices are commonly used to mix and dispense components into cavities of walls of houses, refrigerators and the like, so that the dispensed mixture may be located in a desired position prior to its conversion to a product which has foamed and solidified in situ. Concurrently with the feeding of the foam into the rotatable auger member, there was fed through a second orifice of the device 34 parts per minute of a second component of the explosive composition in the form of an aqueous solution containing 20% of phosphoric acid, and through a third orifice of the device 365 parts per minute of a third component of the explosive composition in the form of an explosive mixture of 94 parts of porous ammonium nitrate prills and 6 parts of diesel fuel oil. The three components were mixed and dispensed in the form of a foam wherein the third component was dispersed. The resultant explosive foam was fed into a cylindrical cardboard tube which was 47 centimeters long and had a diameter of 7.6 centimeters and wherein it cured to a solidified foamed explosive product having a density of 0.45 gram per cubic centimeter. The cardboard tube containing the foamed explosive product was transferred to a steel cylinder having a diameter of 8 centimeters and was detonated therein by means of a booster containing 100 grams of pentolite. The velocity of detonation was 2.4 kilometers per second.

EXAMPLE 9

An explosive composition was prepared by the method of Example 8 except that the areated foam was prepared from 895 parts of urea-formaldehyde syrup, 486 parts of water, 18 parts of "Empimin" AQ 60, 1 part of sodium hydroxide and 90 parts of molasses. The resultant foamed explosive had a density of 0.7 gram per cubic centimeter, and when detonated in a cylindrical steel tube of 8 centimeters diameter by means of a booster containing 60 grams of pentolite it had a velocity of detonation of 2.8 kilometers per second.

EXAMPLE 10

Into an auger mixing device of the type used in Example 8 there was fed concurrently 400 parts per minute of ammonium nitrate prills, 28 parts per minute of "Suprasec" DND and 21 parts per minute of "Daltolac" 41. There was thus obtained a foam through which the prills were dispersed. This foamed product was dispensed by the device into a steel cylinder which had a diameter of 5 centimeters and a length of 50 centimeters wherein it solidified to a foamed explosive composition having a density of 0.35 gram per cubic centimeter and which was detonated by means of 80 grams of pentolite.

EXAMPLE 11

An explosive composition was prepared by the general procedure of Example 10 except that the feed rate of the ammonium nitrate component was increased to a rate such that the resultant product had a density of 0.7 gram per cubic centimeter. This product was stored under water for five days in a cylindrical steel tube having a diameter of 5 centimeters. The water was then removed and the so treated explosive composition was detonated using a booster containing 100 grams of pentolite. The veolocity of detonation was 3.1 kilometers per second.

EXAMPLE 12

An explosive composition was prepared by the general procedure of Example 11 except that the ammonium nitrate prills were treated and mixed with 2% of their weight of diesel fuel oil prior to being fed to the auger mixing device. There was thus obtained an explosive composition having a density of 0.66 gram per cubic centimeters and in which the explosive component was located in a foamed matrix which had been formed in situ, and which when detonated by 90 grams of pentolite had a velocity of detonation of 3.3 kilometers per second.

EXAMPLE 13

An explosive composition was prepared by the general procedure of Example 10 except that the ammonium nitrate component of that example was replaced by a similar amount of prilled fertilizer grade calcium nitrate which comprised 80.5% calcium nitrate, 4.5% ammonium nitrate, 14.4% water with the remainder thereof being inert material. The resultant product had a density of 0.43 gram per cubic centimeter and was detonated in a cylindrical steel tube of diameter 7.5 centimeters by means of 415 grams of pentolite.

EXAMPLE 14

The general procedure of Example 13 was repeated except that the calcium nitrate component of that example was replaced by a similar amount of sodium nitrate. The product so produced had a density of 0.44 gram per cubic centimeter and was detonated by means of 515 grams of pentolite.

EXAMPLE 15

A first mixture comprising 252 parts of polyester resin available commercially from Resinous Chemicals Pty Ltd of Melbourne, Australia, under the designation 120-000, 37.8 parts of calcium carbonate, 8.4 parts of a paste of benzoyl peroxide in dimethyl phthalate in a weight ratio of 1:1, 8.4 parts of a paste of 2,4-dichlorobenzoyl peroxide in silicone oil in a weight ratio of 1:1 and 1.0 part of a foam stabilizer Silicone EP 5859 available commercially from Imperial Chemical Industries Limited of London, England, was prepared. A second mixture comprising 47.0 parts of 90% formic acid and 1.7 parts of dimethylaniline was then added and mixed with the first mixture. 20 parts of water were then added to this total mix and mixed briefly at which point foaming commenced. 840 parts of porous ammonium nitrate prills which had been premixed with 49 parts of fuel oil were then added rapidly to the foaming mix and mixed briefly. The resultant detonable foam set within 5 minutes and had a density of 0.67 gm/cc.

EXAMPLE 6

Using the general procedure of Example 8 there was prepared an explosive composition which was in the form of a mobile foam. This mobile foam was fed to a borehole drilled in a soft rock formation and which had been primed previously in the vicinity of its toe. The foam was allowed to solidify and thereafter a further amount of priming material was placed on top of the explosive, and the borehole was then stemmed. The explosive material was detonated to provide satisfactorily fragmented rock.

We claim:

1. An explosive composition comprising a dispersion of an explosive component which is located in and immobilized by a solidified foamed non-explosive matrix.

2. A composition according to claim 1 wherein the said explosive component comprises at least one inorganic oxygen-releasing salt selected from the group consisting of the nitrate, chlorate, and perchlorate of alkali metals, alkaline earth metals and ammonium.

3. A composition according to claim 1 wherein the said explosive component comprises at least one inorganic oxygen-releasing salt selected from the group consisting of calcium nitrate, potassium nitrate and sodium nitrate.

4. A composition according to claim 1 wherein the said explosive component comprises ammonium nitrate.

5. A composition according to claim 1 wherein the said explosive component comprises, in addition, fuel material.

6. A composition according to claim 5 wherein the said fuel material is fuel oil.

7. A composition according to claim 1 wherein the said matrix comprises polymeric material.

8. A composition according to claim 7 wherein the said matrix comprises material selected from the group consisting of polyesters, polyurethanes and urea-formaldehyde resins.

9. A composition according to claim 1 in which the density of the said composition lies in a range from 0.05 to 0.7 gram per cubic centimeter.

10. A composition according to claim 1 wherein the said explosive component constitutes from 40 to 95% w/w of the said composition.

11. A composition according to claim 1 wherein the said explosive component constitutes from 60 to 90% w/w of the said composition.

12. A process for the preparation of an explosive composition according to claim 1 which process comprises, in combination, dispersing an explosive component in a mobile foam to form a mobile explosive foam and treating said explosive foam so as to convert it to a solidified foamed matrix in which the said explosive component is located and immobilized.

13. A process according to claim 12 which process comprises the steps of blending an explosive component with a non-explosive foamable material, converting said foamable material to a foamed form in a manner such that the said explosive component is dispersed therein, and treating said formed form so as to convert it to a solidified foamed matrix in which the said explosive component is located and immobilized.

14. A process according to claim 12 which process comprises the steps of blending an explosive component with a nonexplosive foamable material and reacting the blend so formed with a catalyst so as to form a solidified foamed matrix in which the said explosive component is located and immobilized.

15. A process according to claim 12 which process comprises the steps of blending an explosive component with a first component of a non-explosive foamable material, admixing therewith a second component of a non-explosive foamable material so as to form an explosive mobile foam and thereafter converting said explosive foam to a solidified foamed matrix in which the said explosive component is located and immobilized.

16. A process according to claim 12 which process comprises the concurrent mixing of a first component comprising explosive material with a second component and a third component, said second and third components being such that when mixed together they form a solidifiable mobile foam and therafter converting the mobile explosive foam so formed to a solidified foamed matrix in which the said explosive component is located and immobilized.

17. A process according to claim 12 which process comprises blending two or more materials which when mixed together form a solidifiable mobile foam, adding to the foam so formed an explosive component so as to form an explosive mobile foam, and treating said explosive foam so as to convert it to a solidified foamed matrix in which the said explosive component is located and immobilized.

* * * * *